US009555448B2

(12) United States Patent
Masia Perales

(10) Patent No.: US 9,555,448 B2
(45) Date of Patent: Jan. 31, 2017

(54) ROBOTISED DEVICE OF CLEANING OF EXTERNAL STEEL STRUCTURES

(75) Inventor: Jordi Masia Perales, L'Alcudia (ES)

(73) Assignee: Eliot Systems, S.L., L'Alcudia (Valencia) (ES)

( * ) Notice: Subject to any disclaimer, the term of this patent is extended or adjusted under 35 U.S.C. 154(b) by 971 days.

(21) Appl. No.: 13/124,098

(22) PCT Filed: Dec. 2, 2010

(86) PCT No.: PCT/ES2010/070795

§ 371 (c)(1),
(2), (4) Date: Jun. 17, 2011

(87) PCT Pub. No.: WO2012/072834

PCT Pub. Date: Jun. 7, 2012

(65) Prior Publication Data

US 2012/0138105 A1 Jun. 7, 2012

(51) Int. Cl.

| | |
|---|---|
| ***B08B 1/00*** | (2006.01) |
| ***B08B 1/04*** | (2006.01) |
| ***B63B 59/10*** | (2006.01) |

(52) U.S. Cl.

CPC ..... *B08B 1/002* (2013.01); *B08B 1/008* (2013.01); *B08B 1/04* (2013.01); *B63B 59/10* (2013.01)

(58) Field of Classification Search

CPC ..... A47L 2201/00; A47L 1/02; A47L 9/009; A47L 9/2852; A47L 11/40; A47L 5/30; A47L 11/24; A47L 11/4041; A47L 11/38; A47L 11/4066; A47L 11/4088; A47L 11/4072; A47L 11/4069; A47L 11/302; A47L 11/4083;A47L 9/02; A47L 11/10; B62D 57/024; B62D 55/265; B62D 55/075; B62D 55/0655; B62D 55/02; B62D 55/06; B62D 55/14; B62D 49/0635; B62D 49/0621; B62D 55/08; B62D 55/00; B63B 59/10; B08B 3/024; B08B 9/049; B08B 1/002; B08B 1/008; B08B 1/04; B25J 5/005

USPC .... 134/6, 18, 172, 198, 36, 188, 99.2; 901/1

See application file for complete search history.

(56) References Cited

U.S. PATENT DOCUMENTS

| | | | | |
|---|---|---|---|---|
| 3,922,991 | A * | 12/1975 | Woods | 114/222 |
| 4,084,535 | A * | 4/1978 | Rees | B63B 59/10 114/222 |
| 2005/0028315 | A1* | 2/2005 | Thomas, Sr. | A47L 11/14 15/320 |

FOREIGN PATENT DOCUMENTS

| | | | | |
|---|---|---|---|---|
| EP | 1650116 | A1 * | 4/2006 | B62D 55/265 |
| KR | CA 2376051 | A1 * | 12/2000 | A47L 1/02 |
| WO | WO-2007025553 | A1 * | 3/2007 | B65D 55/265 |

* cited by examiner

*Primary Examiner* — Joseph L. Perrin
*Assistant Examiner* — Irina Graf
(74) *Attorney, Agent, or Firm* — Richard M. Goldberg

(57) ABSTRACT

Robotized cleaning device used on ferromagnetic structures that includes two symmetrical cleaning arms and a caterpillar type tractor device that moves using magnetic soles over the bands of the caterpillar robot; and where the arms are jointly attached to the tractor device via a structural profile and include a cleaning roller, each of them operated by a reduction motor connected to the roller and nozzles.

8 Claims, 6 Drawing Sheets

ROBOTISED DEVICE OF CLEANING OF EXTERNAL STEEL STRUCTURES

This invention refers to a robotized cleaning device for use on surfaces and external or internal parts of large ferromagnetic structures such as wind turbine towers.

STATE OF THE ART

In the current state of the art, the treatment and/or work on surfaces or parts of ferromagnetic structures is common in the maintenance of skyscrapers, ships and other large structures that require periodic cleaning and/or painting. Also, the maintenance of a building that has a large dome is not easy for the operators to accomplish and is only practical when using scaffolding.

Nowadays, this work is carried out using travelling bridges, which are raised, lowered and moved along the entire surface of the structure; this method imposes a risk to the workers on board the bridge.

Also common is the periodic maintenance required to be carried out on wind generators, which must be cleaned every certain amount of time to prevent jamming due to grease falling from the wind generator itself, which may even cause the barge to seize. These tasks must be carried out using qualified personnel as well as the proper materials and equipment for working at heights. This way, the workers located at heights along the surfaces are always exposed to the risk of suffering accidents and falls. Also, this type of work requires the wind generator to be stopped temporarily with the consequent loss in productivity while the cleaning is being carried out.

Magnetic caterpillar robots, as for example in patent EP 1 650 116, are known where the means for actuation consist of two opposite and independent motors, which remotely and independently control the two opposite caterpillars. This way, the robot can be moved in any direction by moving either of the robot's caterpillars.

The problem with these types of robots is that they are difficult to move equally in any direction.

To solve this problem, European patent EP 1 924 487 was introduced, which describes a robot for treating and/or work on surfaces or external parts of large ferromagnetic structures, where said robot is of the caterpillar type, which moves using magnetic soles over the bands of said caterpillar robot, and includes two independent actuating units, each of them primarily using a ball joint that allows rotation with respect to the central body transversely and subsequently by means of a longitudinal hinge, which allows a high degree of freedom with respect to the other band, since it allows turning each of them transversely as well as longitudinally.

Arms have been installed behind each unit and each of these arms has a magnetic band with freedom to transit and are supported by free rotating wheels.

However, this robot lacks a cleaning system that allows not only movement, but also cleaning of the surface over which the robot is travelling over.

DESCRIPTION OF THE INVENTION

The robotized cleaning device used on external or internal ferromagnetic structures that is described in this invention includes two symmetrical cleaning arms and a caterpillar type tractor device that moves using magnetic soles over the bands of said caterpillar robot, including two independent actuating units that use longitudinal hinges on both sides, one with the other in an intermediate position with respect to the lateral hinges; said lateral hinges including at least an intermediate longitudinal hinge with an intermediate longitudinal axis that is substantially capable of allowing one unit to oscillate laterally and transversely with respect to the other and where the lateral hinges also include a transversal hinge, where said transversal hinge includes a transversal rotating coupling that is substantially capable of allowing one unit to turn with respect to the central body and where arms are installed behind each unit, where each arm is supported by means of respective free rotating wheels; where each cleaning arm is characterized because said arms are jointly attached to the tractor device using a structural profile section and are essentially comprised of a cleaning roller, each of them operated by a reduction motor coupled to said roller and a plurality of nozzles configured for spraying chemical products, pure as well as diluted (depending on the need) over the surface to be cleaned. The chemical product dosing is carried out using a dosing pump. This procedure is carried out by letting the chemicals act for the required time and subsequently using the roller system in the proper direction, and rinsing with water from a container located on the ground. The system is comprised of pipes mounted on nozzles, which can be used for spraying chemicals as well as water. The usage of the pipes depend on the need; they can be used going up as well as going down, spraying chemical products or rinsing with water.

The roller includes a rubber piece configured so that when it is cleaning, the dirt, water residue and chemical products employed in the cleaning are pushed outward. This rubber piece is located between the caterpillars and the roller cover.

This solves the technical problem derived from the joining of a robotized tractor device with a means for cleaning, which allows to independently clean ferromagnetic surfaces, which previously required using qualified operators to accomplish.

Throughout the description and claims, the word "encompasses" and its synonyms do not intend to exclude other technical characteristics, additions, components or steps. For experts in the field, other objectives, advantages and characteristics of this invention will in part be derived from the description and in part from placing the invention into practice. The following examples and drawings provide an illustration and are not intended to limit this invention. Additionally, this invention covers all the possible combinations of particular and preferred embodiments indicated herein.

DETAILED DESCRIPTION OF A METHOD OF EMBODIMENT

Figure 1:
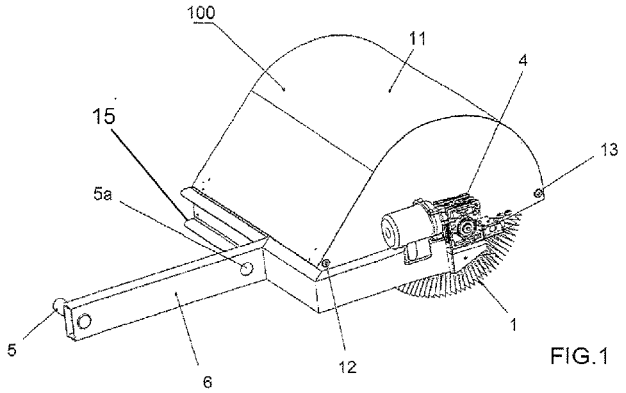
FIG. 1. Shows a view of one of the symmetrical arms that comprise the cleaning means and are an integral part of the robotized ferromagnetic structures cleaning device described in this invention.
Figure 2:
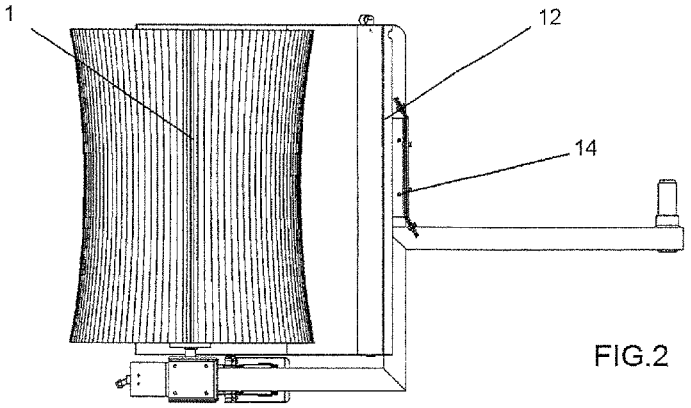
FIG. 2. Shows a bottom view of the arm shown in FIG. 1.

As shown in the attached figures, the cleaning means incorporated in the robotized device described in this invention, essentially include two symmetrical arms (100, 200) represented in FIG. 1, which are jointly attached to a tractor device or robot (300), which travels by means of a system of belts (303) (also referred to herein as bands or tractor chain) and magnets (305) (i.e., the circular elements on the belts 303) and is configured for cleaning metal surfaces, removing grease as well as oil spots and other dirt that is present in large ferromagnetic structures such as for example, wind generator towers or other metal surfaces.

Figure 8:
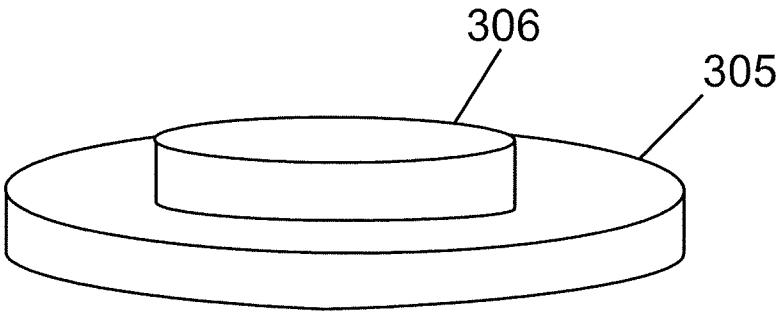
FIG. 8. Shows aspects of a magnet with a polyvinyl chloride shoe.

Said magnets include a type of polyvinyl chloride ("PVC") "shoe" (306) (shown in FIGS. 3, 4 and 8) that lessens the angle of attack of the magnet with the metal surface, aiding its operation.

Water for rinsing the surfaces.

Chemical products in pure form as well as diluted with water.

Figure 5:
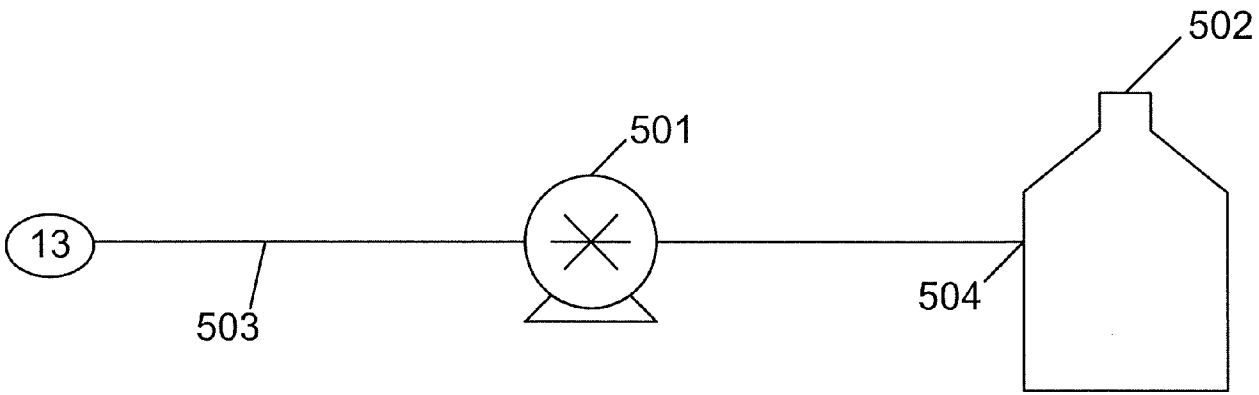
FIG. 5. Shows a view of a chemical products dosing system.

The chemical products are dosed by a dosing pump (501) and travel from the chemical products tank (502) to the chemical products pipes (13) of cleaning arms (100, 200) as shown in FIG. 5.

Figure 3:
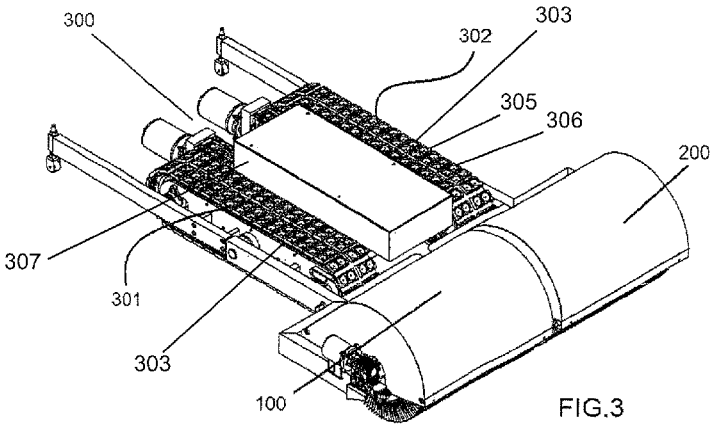
FIG. 3. Shows a view of the robotized ferromagnetic structures cleaning device assembly described in this invention.

In a normal operation of the cleaning arms (100, 200), these are coupled to the tractor machine (300) as seen in FIG. 3, and are divided into two independent actuating units (301, 302); where each one of these actuating units (301, 302) are joined to each other by means of a ball joint (701) that allows transversal rotation (702) with respect to the central body (307) and are also joined by a longitudinal hinge (703) that allows each actuating unit to turn transversely (702) as well as longitudinally (704); and where behind each actuating unit (301, 302), arms (101) are installed, at least one per actuating unit, where each arm (101) is supported by respective free rotating wheels (102).

Figure 6:
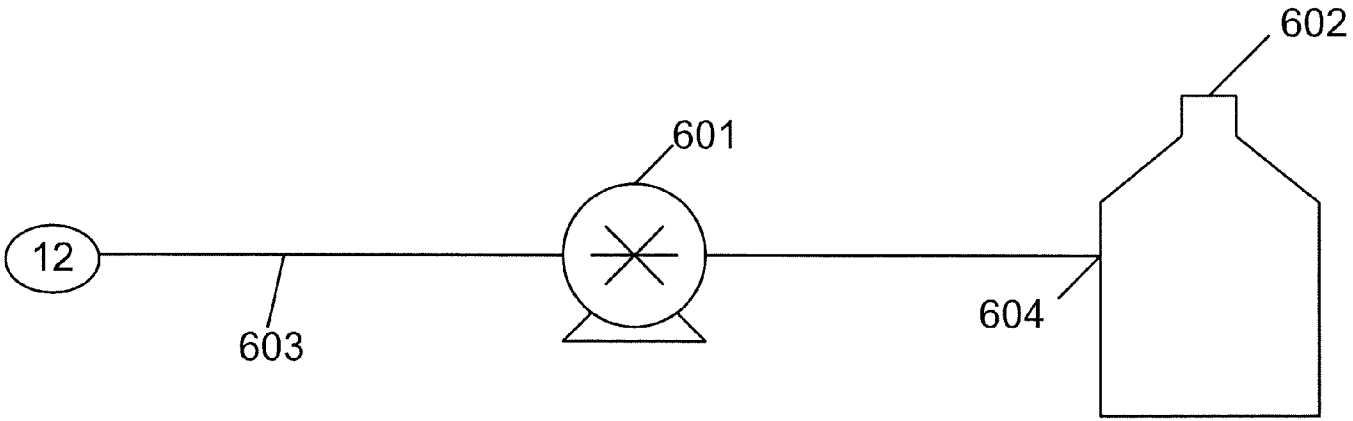
FIG. 6. Shows a view of a water pumping system.
Figure 7:
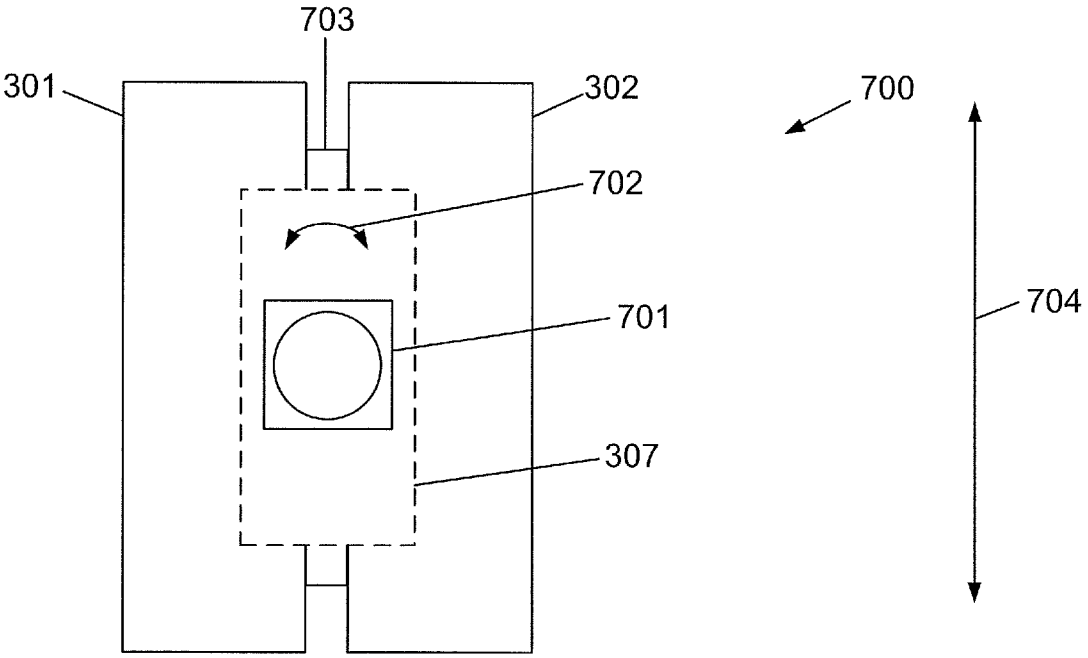
FIG. 7. Shows aspects of a joining arrangement for actuating units.

Subsequently, as shown in FIG. 6, the water pump (601) is turned on, which pumps water out from an external tank (602) and enables the nozzles (14) of the cleaning arms (100, 200) to spray water and chemical product, in pure or diluted form over the metal surface.

After this, the rollers (1) are actuated by their respective reduction motor (4), causing the rollers (1) to start turning. At this moment, the tractor machine (300) is literally adhered to the ferromagnetic surface thanks to the magnets (305) it has installed on the tractor chain (303), which enables the assembly to move up said structure.

At the start of the movement, the dosing pump (501) that is connected to the cleaning fluid tank (502) starts, enabling the chemical cleaning product contained in said tank (502) to flow from the tank 502 outlet 504 through hoses connected to distribution pipes (503) that are common in water installations, and where said pipes (503) are connected to pipe (13) housed inside the roller cover (11).

The structural joining profile (6) is configured for joining the roller (1) motor (4), located at the end of the structural profile (6). Said roller (1) holding profile (6) is attached to the tractor system by means of two attaching points (also referred to herein as joints), one common (5), for example a common built-in joint, and another threaded (5*a*), which can be adjusted depending on the desired strength with which it is fastened to the metal surface (also referred to herein as an adjustable threaded joint).

Once the roller (1) is spinning and is therefore cleaning the surface to be treated, water is sprayed over said rollers (1) which will rinse what has already been cleaned and remove the water along with the excess chemical product and the dirt, which are removed from the treated surface.

Figure 4:
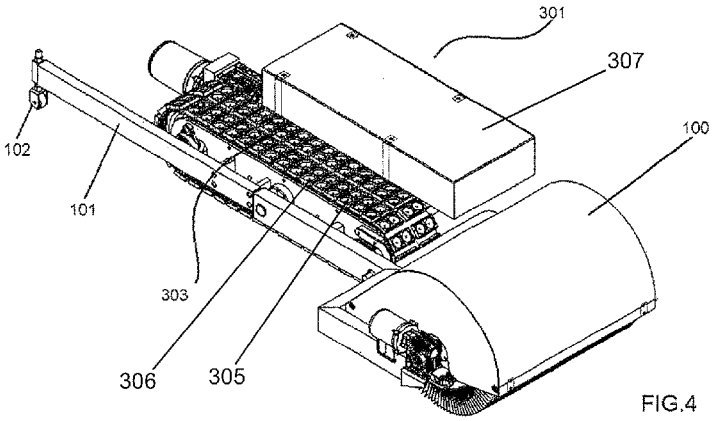
FIG. 4. Shows a view of the assembly of FIG. 3 that only shows the actuating unit and one arm.

This cleaning of the chemical product, water and residue is materialized by means of a rubber piece 15 located midway between the roller (1) and the tractor's (300) caterpillars as shown in FIGS. 1, 3 and 4.

An arm (101) is installed on the back side of the roller position with a support wheel (102) that acts as a crowbar in such a manner that, when in the operating position, it compensates for the weight of said roller and facilitates the pushing action of the tractor (300) device.

Use of the Device for Cleaning Wind Generator Towers

A non-limiting application of the robotized device described in this invention is the cleaning of wind generator towers, which allows cleaning the towers without having to stop them from operating. This cleaning is carried out going up as well as going down. In this specific application, the operating sequence of the device is described below:

1) All electrical as well as water and chemical product pipe connections are connected. The external pump adjacent to the external water tank is started.
2) A cycle is carried out, which will be repeated as many times as necessary for cleaning the wind generator.
3) Step 1. Spraying
   Actuation of the chemical product spray nozzles (14) that are located on the piping (13), depositing the product on the tower as the tractor (300) travels upward at a distance that may vary depending on the drying of said chemical product.
4) Step 2. Rinsing-Spraying.
   Rinsing: Upon reaching the desired position for the tractor (300), the reduction motors (4) for the rollers (1) are started, which are rinsed with sprayed water from the water pipes (12); the constant rubbing of the roller (1) as it is climbing will clean the surface, pushing the dirt as well as the chemical product outward.
   Spraying: At the same time the metal surface is being sprayed with the chemical product through the spray nozzles located on the chemical product pipe (13) in order to begin treating the surface prior to starting over with the rinsing cycle.
   Removal of residues: As the roller is spinning, the dirty water and chemical products residue are pushed towards the sides by a rubber piece to prevent the residue from falling on the magnets and cause a loss of adherence.
5) Upon completion of both steps, we find ourselves in a higher position than in step 1 and it will be at that moment when we restart the cycle.
6) When we reach the top part of the wind generator, we will descend with a slight inclination in order to reach a position where we can restart the cycle.
7) These steps will be repeated until the wind generator has been cleaned completely.
8) Disconnection of the external pump.
9) Disconnecting of all electrical systems as well as of the water pipes and chemical product pipes.

The invention claimed is:

1. A robotized cleaning device for use on a ferromagnetic structure, comprising a robot comprising:

two adjacent cleaning units, each of the cleaning units comprising a cleaning roller and a reduction motor, each cleaning roller operable by the respective reduction motor, each of the cleaning units comprising a cover positioned above a respective cleaning roller having a plurality of pipes configured for spraying water and a chemical product through a plurality of spray nozzles arranged in the cover, wherein the chemical product is configured to be sprayed in a concentrated or a dilute form over the ferromagnetic structure;

a robot comprising two actuating units, each actuating unit including a caterpillar type tractor device comprising a plurality of belts for moving the robot;

each belt comprising magnetic elements;

two actuating unit arms, each actuating unit arm attached to the corresponding actuating unit, wherein each actuating unit arm extends rearwardly past the actuating units and is supported by a respective free rotating wheel at a free end thereof; and two profiles, each profile attached to the corresponding actuating unit and extends forwardly past the actuating units and aligned with the respective actuating unit arm, wherein each profile supports the respective cleaning roller and the respective reduction motor;

and the cleaning units are aligned with actuating unit arms, so that when the cleaning units are in an operating position, the actuating unit arms support the weight of the cleaning rollers and facilitate a pushing action of the robot;

a ball joint for connecting together the actuating units for transverse rotation of the actuating units and thereby the cleaning units relative to each other; and a longitudinal hinge for connecting together the actuating units such that each actuating unit, and thereby, each cleaning unit, is configured to move transversely and longitudinally relative to the other actuating unit and cleaning unit to provide independent movement of each actuating unit and cleaning unit relative to the other actuating unit and cleaning unit.

2. The device according to claim 1, comprising a dosing pump configured to pump the chemical product from a cleaning fluid tank to the device for a period of time to dose the chemical product onto the ferromagnetic structure, wherein the dosing pump is arranged at an exit of the cleaning fluid tank.

3. The device according to claim 1, wherein the cleaning rollers are movable to clean the ferromagnetic structure and water from a tank is supplied to the spray nozzles for rinsing the ferromagnetic structure.

4. The device according to claim 1, wherein the device is movable in a plurality of directions while spraying one or more of the chemical product and the water on the ferromagnetic structure, and wherein the device is movable up and down the ferromagnetic structure, and wherein each of the magnetic elements comprises a polyvinyl chloride (PVC) component.

5. The device according to claim 1, comprising a tank for storing the water and an external pump in fluid communication with an external pipe attached to the plurality of pipes, the external pump arranged to pump the water from the tank.

6. The device according to claim 1, wherein a first of the plurality of pipes is arranged in front of each cleaning roller, and a second of the plurality of pipes is arranged behind each cleaning roller, and wherein the first and the second of the plurality of pipes are configured to receive the water and the chemical product, wherein the first and the second of the plurality of pipes are arranged inside a casing external to each cleaning roller.

7. The device according to claim 1, wherein the profile comprises a structural joint configured to join the cleaning roller with the reduction motor, and wherein the profile is connected to the robot by an adjustable threaded joint and a common built-in joint.

8. The device according to claim 1, wherein the cleaning units each comprise a rubber element for directing water and chemical residue from cleaning away from the robot.

* * * * *